US011150594B2

(12) United States Patent
Ishii et al.

(10) Patent No.: US 11,150,594 B2
(45) Date of Patent: Oct. 19, 2021

(54) IMAGE FORMING APPARATUS HAVING A PROTECTIVE AGENT COATER

(71) Applicant: HEWLETT-PACKARD DEVELOPMENT COMPANY, L.P., Spring, TX (US)

(72) Inventors: Yasuyuki Ishii, Kanagawa (JP); Takayuki Wakai, Kanagawa (JP); Yoichi Yoshida, Kanagawa (JP)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/050,646

(22) PCT Filed: Jul. 19, 2019

(86) PCT No.: PCT/US2019/042613

§ 371 (c)(1),
(2) Date: Oct. 26, 2020

(87) PCT Pub. No.: WO2020/018909

PCT Pub. Date: Jan. 23, 2020

(65) Prior Publication Data

US 2021/0240124 A1 Aug. 5, 2021

(30) Foreign Application Priority Data

Jul. 20, 2018 (JP) ..... JP2018-136681

(51) Int. Cl.
*G03G 21/00* (2006.01)
*G03G 15/02* (2006.01)

(52) U.S. Cl.
CPC ..... *G03G 21/0029* (2013.01); *G03G 15/0258* (2013.01); *G03G 21/0058* (2013.01); *G03G 21/0094* (2013.01)

(58) Field of Classification Search
CPC ..... G03G 21/0011; G03G 21/0094
USPC ..... 399/346, 350
See application file for complete search history.

(56) References Cited

U.S. PATENT DOCUMENTS

| | | | | |
|---|---|---|---|---|
| 7,953,363 | B2 * | 5/2011 | Honjoh et al. | F16N 7/24 399/346 |
| 9,897,966 | B2 * | 2/2018 | Haga | G03G 21/0094 |
| 10,746,352 | B2 * | 8/2020 | Azuma | G03G 21/0094 |

FOREIGN PATENT DOCUMENTS

| | | |
|---|---|---|
| CN | 101266415 B | 2/2012 |
| CN | 102081337 B | 7/2013 |
| JP | 2005173351 | 6/2005 |
| JP | 2005275166 | 10/2005 |
| JP | 2010266811 A | 11/2010 |
| JP | 2011248203 | 12/2011 |

(Continued)

*Primary Examiner* — William J Royer
(74) *Attorney, Agent, or Firm* — Trop Pruner & Hu, P.C.

(57) ABSTRACT

An image forming apparatus includes an image carrier to rotate about a rotation axis, a cleaning blade to contact a surface of the image carrier, and a protective agent coater. The protective agent coater has a rotatable shaft extending along the rotation axis of the image carrier, an elastic body formed around the rotatable shaft, and a waste toner supply member. The waste toner supply member supplies waste toner to the elastic body of the protective agent coater. The elastic body transfers protective agent from a protective agent supply to the image carrier. The protective agent coater is positioned upstream of the cleaning blade in the rotation direction of the image carrier.

15 Claims, 6 Drawing Sheets

(56) References Cited

FOREIGN PATENT DOCUMENTS

| | | | |
|---|---|---|---|
| JP | 5471171 | B2 | 4/2014 |
| JP | 2017151472 | | 8/2017 |
| JP | 2017211405 | | 11/2017 |
| KR | 1020070025368 | | 3/2007 |

* cited by examiner

IMAGE FORMING APPARATUS HAVING A PROTECTIVE AGENT COATER

BACKGROUND

An image forming apparatus can electrophotographically print a toner image. FIG. 5 is a cross-sectional view schematically showing the vicinity around a photosensitive body of an image forming apparatus 1 for electrophotographically printing a toner image. The image forming apparatus 1 is an apparatus which can form a color image using, for example, magenta, yellow, cyan and black colors. As shown in FIG. 5, the image forming apparatus 1 comprises a photosensitive body 2 (image carrier), a charging roller 3, a developing device 4, a coater roller 5 for applying a protective agent to the photosensitive body 2, a protective agent supply 6, and a cleaning blade 7, and the coater roller 5 and the protective agent supply 6 form a protective agent coater member. The image forming apparatus 1 is further provided with a conveyance device for conveying a paper sheet, an exposure device for exposing the surface 2*b* of the photosensitive body 2, a transfer device for secondarily transferring the toner image onto the paper sheet, a fixing device for fixing the toner image to the paper sheet, and a discharge device for discharging the paper sheet, although these are not shown or described herein.

In such image forming apparatus 1, the protective agent supply 6 makes contact with an elastic body 14 (the elastic body 14 will be described later with reference to FIG. 6) of the coater roller 5 so that the protective agent is carried by the elastic body 14, and the protective agent carried by the elastic body 14 is applied substantially to the entire surface of the photosensitive body 2 when the photosensitive body 2 rotates with the coater roller 5.

DETAILED DESCRIPTION

In the following description, with reference to the drawings, the same reference numbers are assigned to the same components or to similar components having the same function, and overlapping description is omitted.

Figure 5:
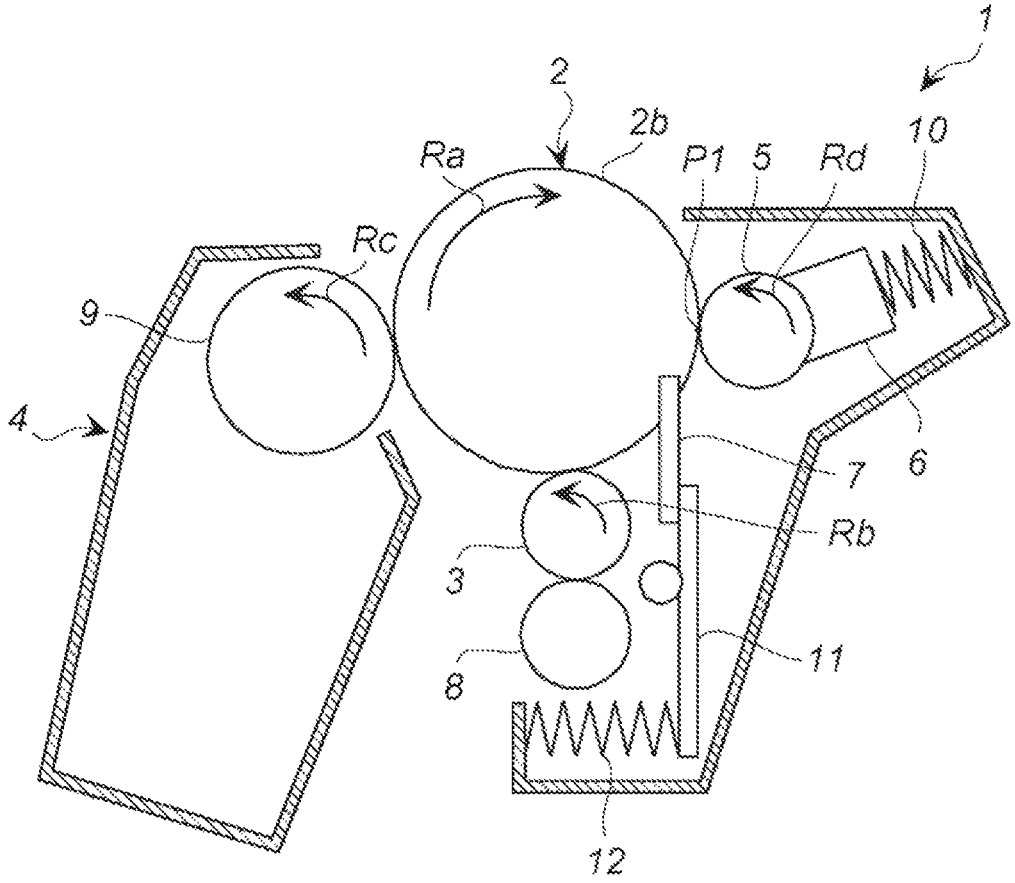
FIG. 5 is a cross sectional view schematically showing the vicinity around a photosensitive body of an image forming apparatus.

In the aforementioned image forming apparatus 1 of FIG. 5, the amount of protective agent applied by the protective agent coater member (also referred to as "protective agent coater") onto the surface of the photosensitive body may be insufficient and, if the protective agent applied over the surface of the photosensitive body is thin, then the surface of the photosensitive body may be scraped along with the protective agent by the cleaning blade, which may affect the lifespan of the photosensitive body. As such, in order to prolong the life of the photosensitive body, the protective agent may have to be applied substantially over the entire surface of the photosensitive body uniformly and in a suitable amount. However, the amount of protective agent to be scraped off from the protective agent supply by the elastic body of the coater roller in the image forming apparatus 1 may differ depending on the amount of transfer residual toner not having been scraped off by the cleaning blade and carried on the surface of the elastic body of the coater roller. Further, the carried amount of the transfer residual toner may be insufficient. Accordingly, it may be difficult to apply the protective agent over the surface of the photosensitive body uniformly and in a sufficient amount.

In some image forming apparatuses, the amount of toner on a photosensitive body may be adjusted by controlling a recovery amount of toner present on the photosensitive body in response to an area ratio of image, so as to stabilize the thickness of a coated lubricant layer formed on the surface of the photosensitive body.

However, in such an image forming apparatus, the amount of protective agent applied to the surface of the photosensitive body is also limited by the amount of protective agent scraped off from a protective agent supply by an applicator brush carrying transfer residual toner, similarly to the aforementioned image forming apparatus 1 of FIG. 5, and thus, beyond such limitation, the amount of protective agent applied to the surface of the photosensitive body may be insufficient.

Figure 1:
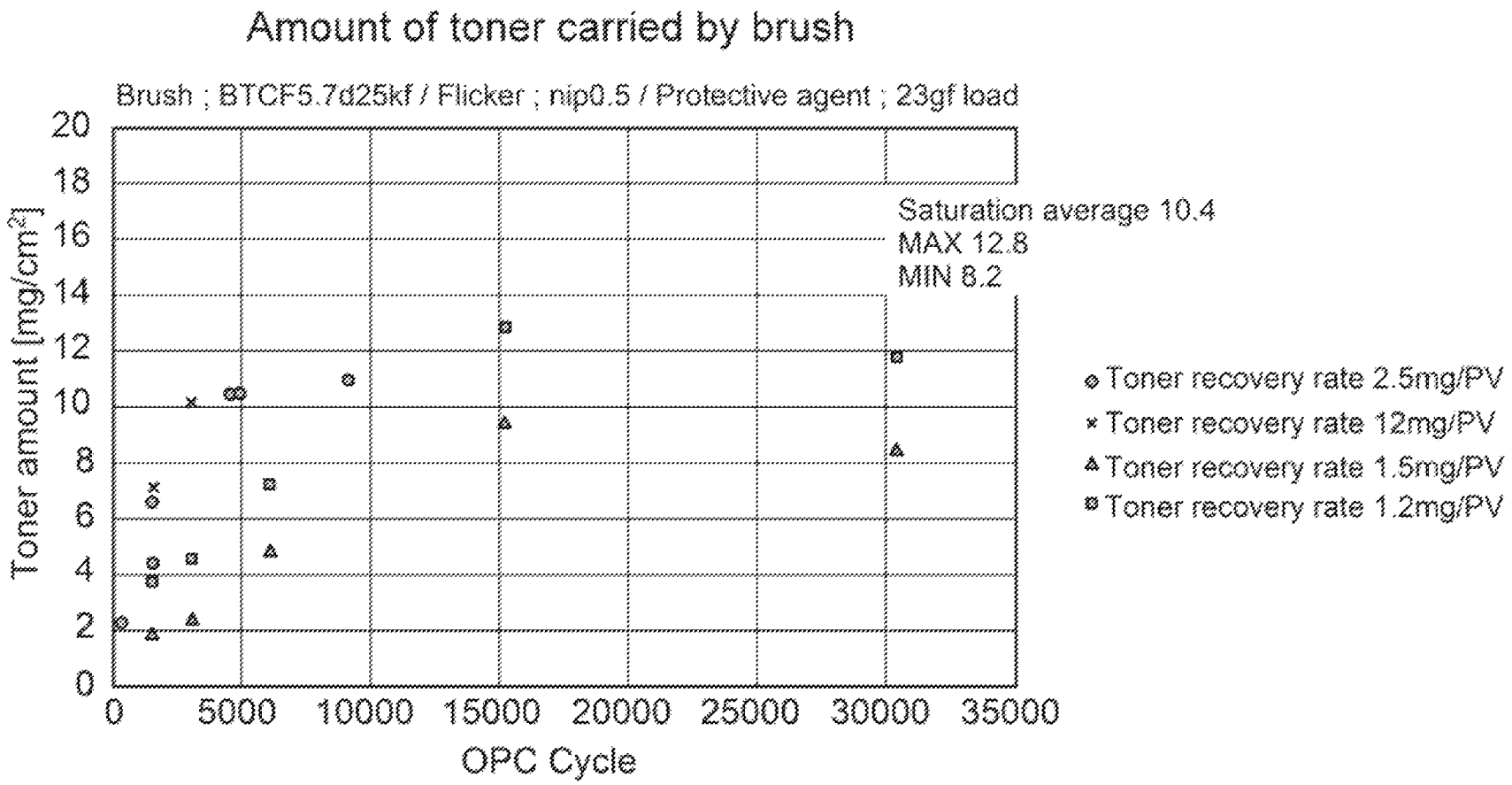
FIG. 1 is a graph showing an amount of toner carried by an applicator brush in relation to OPC cycles, when printed at four different printing rates.

FIG. 1 is a graph showing the result of measurement of the amount of toner carried by an applicator brush (having a bristle thickness of 5.7 d, and a bristle density of 25 kf) to the number of OPC (organic photo conductor) cycles (corresponding to the number of rotations of the applicator brush) obtained by printing at four different printing rates, respectively corresponding to toner recovery rates of 1.2 mg/PV, 1.5 mg/PV, 2.5 mg/PV and 12 mg/PV. As may be understood from FIG. 1, it has been found that, as the number of OPC cycles increases, the amount of toner carried by the coater roller eventually saturates at approximately the same constant level (about 10 mg/cm$^2$ in FIG. 1).

Based on the above-described finding, provided are means for supplying waste toner or transfer residual toner (i.e., waste toner supply member or transfer residual toner supply member) to the protective agent coater member, so as to apply a protective agent to an image carrier uniformly and in a sufficient amount.

An example image forming apparatus comprises: a rotatable image carrier; a cleaning blade for cleaning a surface of the image carrier by making contact with the surface of the image carrier; and a protective agent coater member (also referred to herein as "protective agent coater"). The protective agent coater member (or protective agent coater) may have a rotatable shaft extending along the rotation axis of the image carrier, an elastic body formed around the shaft, and a protective agent supply for making contact with the elastic body so that the protective agent is carried by the elastic body. The protective agent coater member may be provided with a waste toner supply member, and may be positioned upstream of the cleaning blade in the rotation direction of the image carrier for supplying the elastic body with waste toner. The protective agent coater member may be at least in part, positioned upstream of the cleaning blade, relative to the rotation direction of the image carrier. For example, at least the elastic body of the protective agent coater member may be positioned upstream of the cleaning blade, relative to the rotation direction of the image carrier.

Accordingly, with the provision of the waste toner supply member for supplying waste toner to the elastic body of the protective agent coater member, the elastic body supplied with the waste toner can scrape off more of the protective agent from the protective agent supply and, as a result, the protective agent coater member can apply more of the protective agent to the image carrier. Therefore, the life of the image carrier can be prolonged.

In another example, the waste toner supply member may include a single rotary body disposed in the vicinity of the surface of the elastic body and a waste toner transport unit to perform both the drawing up of the waste toner from the waste toner transport unit and the supplying of the waste toner to the elastic body. The rotary body may be in the vicinity of the waste toner transport unit such that the waste toner transported by a waste toner transport auger inside the waste toner transport unit is rubbed between the rotary body and the waste toner transport auger and the waste toner can be acquired by an outer circumferential portion of the rotary body, and disposed in the vicinity of the elastic body such that, as the rotary body rotates, the acquired waste toner can be drawn up and supplied to the surface of the elastic body.

Accordingly, the drawing up of the waste toner from the waste toner transport unit and the supplying of the waste toner to the elastic body can be implemented in parallel by one member, and the waste toner supply member can be implemented more easily and at a lower cost.

In another example of the image forming apparatus, the waste toner supply member includes a first rotary body disposed in the vicinity of the waste toner transport unit and a second rotary body disposed in the vicinity of the first rotary body and the elastic body. The first rotary body may be in the vicinity of the waste toner transport unit such that the waste toner transported by a waste toner transport auger inside the waste toner transport unit is rubbed between the first rotary body and the waste toner transport auger and the waste toner can be acquired by an outer circumferential portion of the first rotary body, and disposed in the vicinity of the second rotary body such that, as the first rotary body rotates, the acquired waste toner can be drawn up and supplied to an outer peripheral portion of the second rotary body that is rotated with the first rotary body, and the second rotary body is disposed in the vicinity of the elastic body such that the waste toner supplied from the first rotary body can be supplied to the surface of the elastic body.

In this manner, by separately implementing the drawing up of the waste toner from the waste toner transport unit and the supplying of the waste toner to the elastic body with different rotary bodies, the drawing up of the waste toner and the supplying of the waste toner to the elastic body can be implemented more efficiently.

In another example, the image forming apparatus comprises: a rotatable image carrier; a cleaning blade for cleaning a surface of the image carrier by making contact with the surface of the image carrier; and a protective agent coater member (or protective agent coater). The protective agent coater member may have a rotatable shaft extending along the rotation axis of the image carrier, an elastic body formed around the shaft, and a protective agent supply for making contact with the elastic body so that the protective agent is carried by the elastic body. The protective agent coater member may be provided with a fixed body, and may be positioned upstream from the cleaning blade in the rotation direction of the image carrier for supplying the elastic body with transfer residual toner. The fixed body may be disposed in the vicinity of the elastic body such that transfer residual toner on the image carrier routed through a surface of the elastic body is temporarily stored on the fixed body. The protective agent coater member may be at least in part, positioned upstream of the cleaning blade, relative to the rotation direction of the image carrier. For example, at least the elastic body of the protective agent coater member may be positioned upstream of the cleaning blade, relative to the rotation direction of the image carrier.

In another example, with the provision of the fixed body adapted to store the transfer residual toner and supply to the elastic body, more of the transfer residual toner can be carried by the elastic body and the elastic body can thus scrape off more of the protective agent from the protective agent supply and, as a result, the protective agent coater member can apply more of the protective agent to the image carrier. Accordingly, the life of the image carrier may be prolonged.

In another example of the image forming apparatus, the protective agent coater member is provided with a flicker (flicker member) disposed downstream of the waste toner supply member in the rotation direction of the coater roller (i.e., elastic body) between the contact portion of the elastic body with the protective agent supply (the protective agent thereof) and the waste toner supply member The flicker (flicker member) makes contact with a surface of the elastic body.

In this case, the waste toner supplied from the waste toner supply member and the transfer residual toner not having been scraped off by the cleaning blade can be uniformly adhered to the elastic body, and consequently the protective agent can be uniformly scraped off from the protective agent supply. Accordingly, a sufficient amount of protective agent can be uniformly applied to the surface of the image carrier. A similar flicker may be provided in a similar position of the protective agent coater member in the afore-mentioned example image forming apparatuses, to obtain a similar effect.

According to examples described herein, the life of the image carrier (photosensitive body) can be prolonged by protecting the image carrier from abrasion by the cleaning blade.

An image forming apparatus is shown in FIG. 5. The image forming apparatus 1 includes four photosensitive bodies 2, corresponding to the respective colors used for color images. The photosensitive body 2 is a drum-shaped latent image carrier (photosensitive drum), on the circumferential surface of which (surface 2*b*) the image is to be formed. The photosensitive body 2 is formed of, for example, an OPC (Organic Photo Conductor). The photosensitive body 2 is rotationally driven by a drive motor (not shown) at a constant speed in the direction of an arrow Ra.

A charging roller 3 is provided on the circumference of the photosensitive body 2. The charging roller 3 is a charge means for charging the surface 2*b* of the photosensitive body 2 uniformly at a predetermined potential. The charging roller 3 rotates to follow the rotation of the photosensitive body 2 in the direction of an arrow Rb. The surface 2*b* of the photosensitive body 2 charged by the charging roller 3 is exposed by an exposure device in accordance with an image to be formed on paper. The potential changes at the exposed portions on the surface 2*b* of the photosensitive body 2. A cleaning roller 8 is provided on the circumference of the charging roller 3. The cleaning roller 8 may be a cleaner means for cleaning the surface of the charging roller 3.

Four developing devices 4 are provided in the image forming apparatus 1, corresponding to the respective colors used for color images. The developing device 4 includes a developer roller 9 provided on the circumference of the photosensitive body 2. The developer roller 9 rotates to follow the rotation of the photosensitive body 2 in the direction of an arrow Rc. The developing device 4 develops the electrostatic latent image formed with toner supplied from a toner tank (not shown) on the photosensitive body 2 to form a toner image. The developing device 4 mixes and stirs the toner with a carrier to charge it sufficiently, after which a developer formed by mixing the toner and the carrier is carried on the developer roller 9. Then, when the developer is transported by the rotation of the developer roller 9 to a region opposing the photosensitive body 2, the toner is moved out of the developer carried on the developer roller 9 to the electrostatic latent image formed on the circumferential surface 2*b* of the photosensitive body 2, to thereby develop the electrostatic latent image.

A coater roller 5 is mounted on the circumference of the photosensitive body 2. The coater roller 5 is located between the developer roller 9 and a cleaning blade 7 on the circumference of the photosensitive body 2. The coater roller 5 is positioned upstream from the cleaning blade 7 in the rotation direction of the photosensitive body 2. The coater roller 5 rotates to follow the rotation of the photosensitive body 2 in the direction of an arrow Rd. The coater roller 5 carries a protective agent supplied from a protective agent supply 6. The coater roller 5 applies the carried protective agent to the surface 2*b* of the photosensitive body 2.

The protective agent supply 6 is provided to contact the coater roller 5. The protective agent supply 6 contacts an elastic body 14 (see FIG. 6) of the coater roller 5 so that the protective agent is carried by the coater roller 5. The protective agent supply 6 may be, for example, a molded body prepared by molding the protective agent into a predetermined shape (rod, prism or cylinder). For use, the molded protective agent supply 6 may be attached with an adhesive to a substrate of metal, metal alloy or plastic.

The image forming apparatus 1 may further comprise an elastic member 10 (e.g. pressurizing means) that pressurizes the protective agent supply 6 to the elastic body 14 (see FIG. 6) of the coater roller 5. The protective agent supply 6 is pressurized by the elastic member 10 and pressed against the elastic body 14 of the coater roller 5. When pressed against the elastic body 14, the protective agent supply 6 is scraped and ground into fine particles, and the fine particles are smeared between the elastic body 14 and the surface 2*b* of the photosensitive body 2 and made into a material that is adhered as a thin-film onto the surface 2*b* of the photosensitive body 2. The protective agent supply 6 may be a molded body of a fatty acid metal salt. The protective agent supply 6 may be made by adding a predetermined amount of an inorganic lubricant or silicone resin to the fatty acid metal salt, for use to enhance the lubricity of the surface 2*b* of the photosensitive body 2.

The cleaning blade 7 collects toner remaining on the photosensitive body 2 after the toner image has been primarily transferred from the photosensitive body 2 to an intermediate transfer body (e.g. transfer residual toner). The cleaning blade 7 may be formed of an elastic body such as urethane rubber. The cleaning blade 7 may be swingably supported by a holder member 11, and pressed against the surface 2*b* of the photosensitive body 2 by elastic force of an elastic member 12 that applies load to the holder member 11. The cleaning blade 7 abuts (contacts) against the surface 2*b* of the photosensitive body 2 to scrape off the transfer residual toner from the surface 2*b* of the photosensitive body 2.

Figure 6:
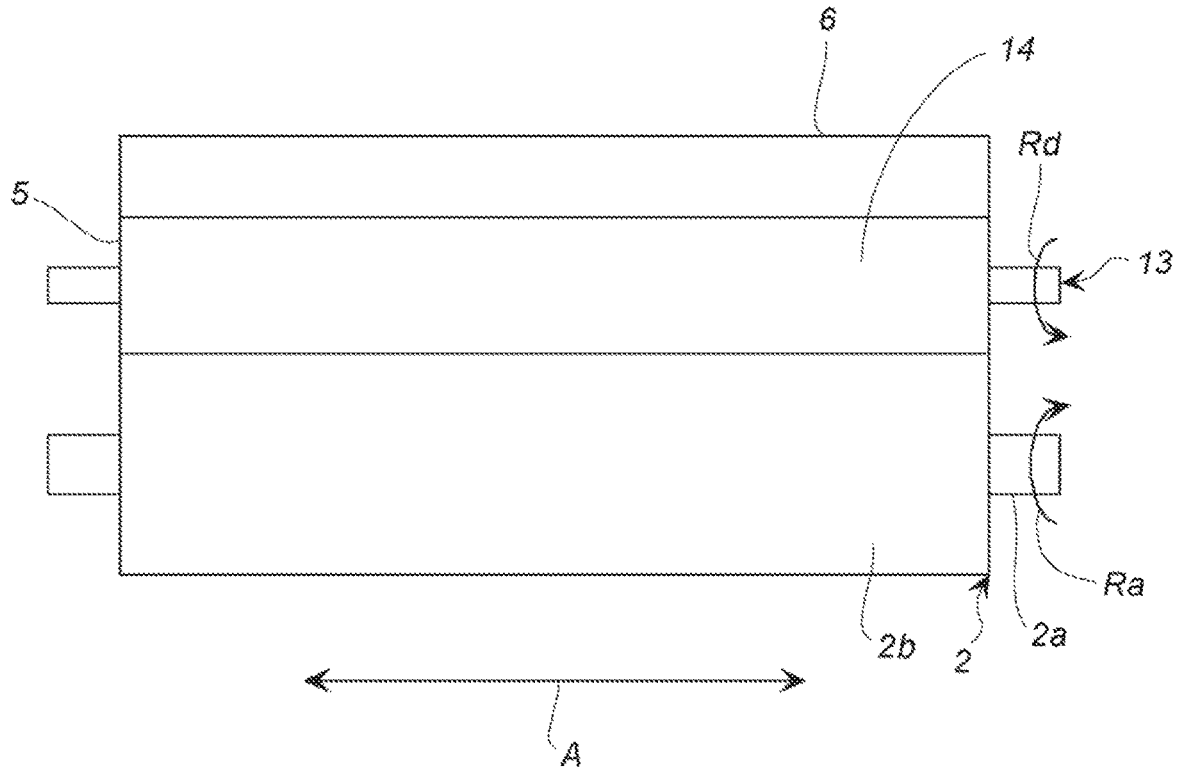
FIG. 6 is a side view showing a coater roller and a protective agent supply provided around the photosensitive body of the image forming apparatus shown in FIG. 5.

FIG. 6 is a side view showing the coater roller 5 and the protective agent supply 6 provided around the photosensitive body 2.

As shown in FIG. 6, the coater roller 5 has a rotatable shaft 13 and the elastic body 14 formed around the circumferential surface of the shaft 13. The shaft 13 is rotatably supported in the image forming apparatus 1. The shaft is formed of, for example, a resin (such as epoxy resin or phenol resin) or metal (such as iron, aluminum or stainless). The shaft 13 may have a columnar or cylindrical shape. The shaft 13 extends along a rotational shaft 2*a* of the photosensitive body 2. Hereinafter, the direction along the rotational shaft 2*a* of the photosensitive body 2 may also be simply referred to as "axial direction A".

As shown in FIG. 6, the coater roller 5 may contact the photosensitive body 2 over the entire region of the surface 2*b* opposing the coater roller 5. As the photosensitive body 2 and the coater roller 5 rotate together, the contact region of the surface 2*b* of the photosensitive body 2 with the surface of the elastic body 14 moves in the rotation direction of the arrow Ra, and the protective agent carried by the elastic body 14 of the coater roller 5 is thereby applied substantially over the entire surface 2*b* of the photosensitive body 2.

The elastic body 14 is formed to protrude from the circumferential surface of the shaft 13, and is also formed to cover the entire circumferential surface of the shaft 13.

As shown in FIG. 6, the elastic body 14 is a part of the coater roller 5 that contacts the protective agent supply 6 and the surface 2*b* of the photosensitive body 2. The elastic body 14 acquires protective agent from the protective agent supply 6 and carries the protective agent by contacting the protective agent supply 6. The elastic body 14 applies the carried protective agent over the protective agent application region on the surface 2*b* of the photosensitive body 2 by contacting the surface 2*b* of the photosensitive body 2. The protective agent application region is a region on the surface 2*b* of the photosensitive body 2 over which the protective agent is applied by the coater roller 5. The protective agent application region extends along the axial direction A to face the surface of the elastic body 14 of the coater roller 5, and extends over the entire circumferential region of the photosensitive body 2 since the surface 2*b* moves as the photosensitive body 2 rotates.

As the elastic body 14 is formed to cover the entire circumferential surface of the shaft 13, the coater roller 5 makes contact with the entire region of the surface 2*b* of the photosensitive body 2 opposing the coater roller 5. As the elastic body 14 carrying the protective agent makes contact with the surface 2*b* of the photosensitive body 2, the protective agent is applied to the surface 2*b*.

The photosensitive body 2 rotates in the direction indicated by the arrow Ra and the coater roller 5 rotates in the direction indicated by the arrow Rd that is opposite in direction to the arrow Ra. That is, the photosensitive body 2 and the coater roller 5 are rotated in opposite directions. As such, at the contact position of the surface 2*b* of the photosensitive body 2 with the surface of the elastic body 14, the direction of movement of the surface 2*b* of the photosensitive body 2 and the direction of movement of the surface of the elastic body 14 are both directed from the front side to the rear side of the plane of paper in FIG. 6. That is, at that contact position, the direction of movement of the surface 2*b* of the photosensitive body 2 and the direction of movement of the surface of the elastic body 14 are the same. The photosensitive body 2 is constructed by layering a plurality of layers. For example, the photosensitive body 2 may include a conductive support body, and a photosensitive layer formed over the conductive support body.

The elastic body 14 may be made of raised fibers. For example, the elastic body 14 may be a brush-like elastic body. The raised fibers may be made to have flexibility, so as to suppress mechanical stress to the surface 2*b* of the photosensitive body 2. Such flexible raised fibers may include, for example, polyolefin resins (such as polyethylene or polypropylene). The elastic body 14 may be constructed as a brush-like elastic body by planting such fibers on a resin and fixing it to a core.

The elastic body 14 may be formed of a foam body (foam layer), instead of the raised fibers. For example, the elastic body 14 may be formed as a spongy elastic body. The foam body may include polyurethane foam.

Figure 2:
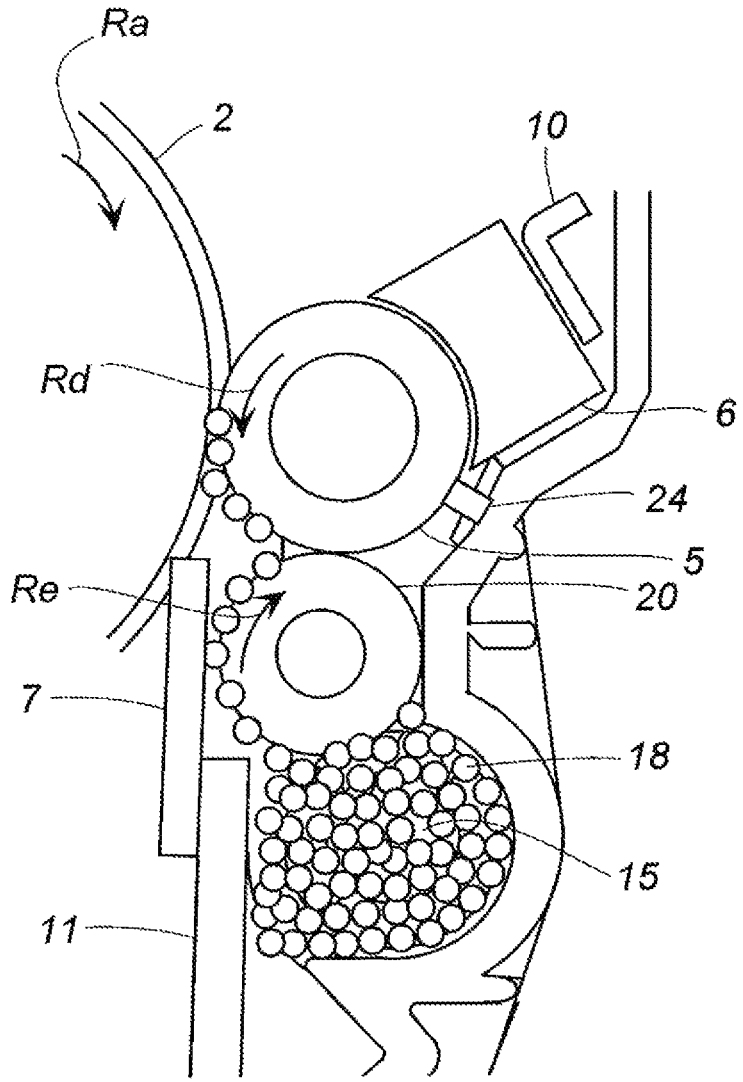
FIG. 2 is a cross-sectional view schematically showing the vicinity around a photosensitive body of an image forming apparatus provided with a protective agent coater member, according to an example.
Figure 3:
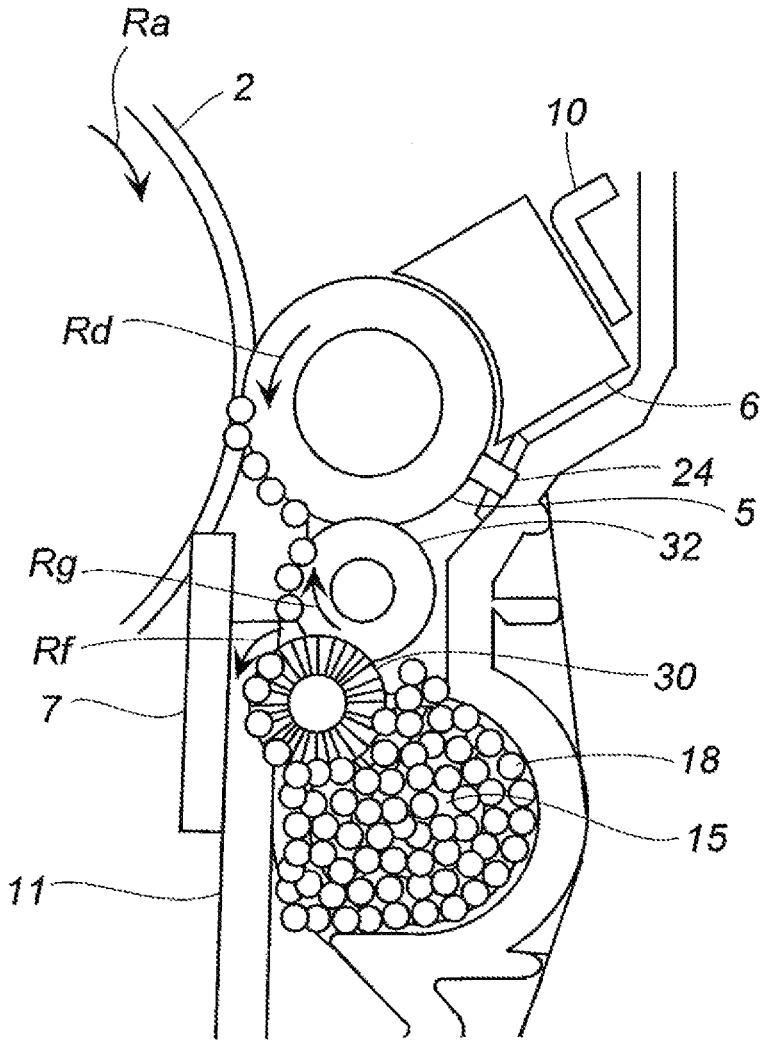
FIG. 3 is a cross-sectional view schematically showing the vicinity around a photosensitive body of an image forming apparatus provided with a protective agent coater member, according to an example.
Figure 4:
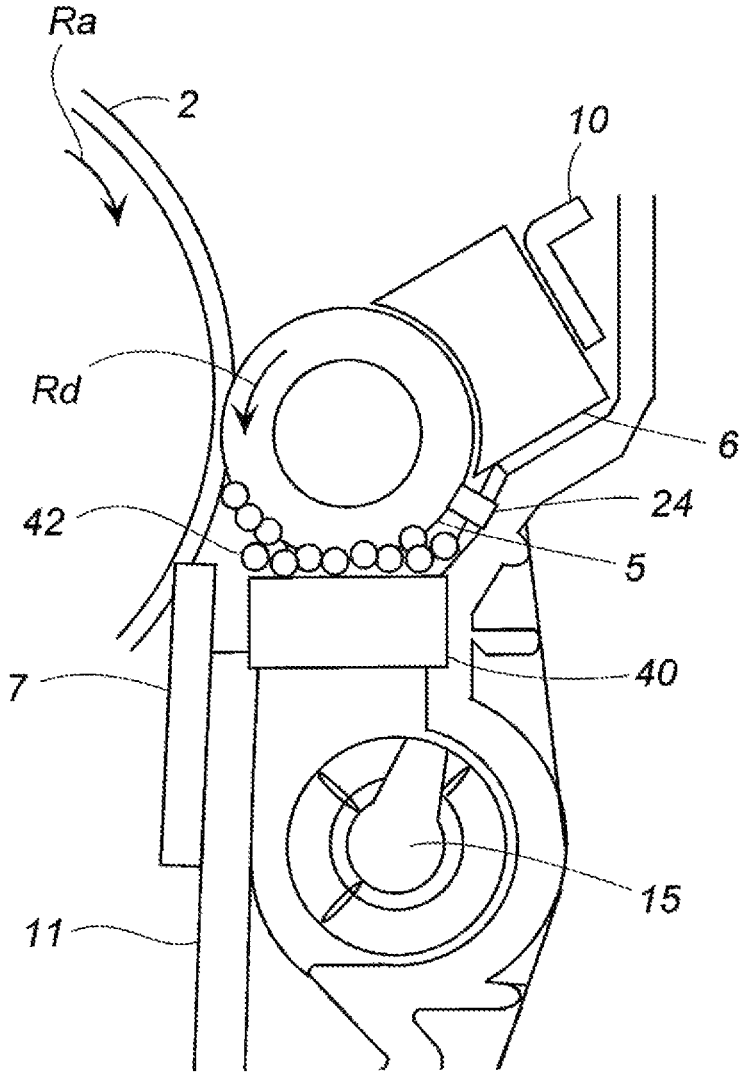
FIG. 4 is a cross-sectional view schematically showing the vicinity around a photosensitive body of an image forming apparatus provided with a protective agent coater member, according to an example.

FIG. 2 to FIG. 4 show example image forming apparatuses, where the charging roller 3, the developing device 4, the cleaning roller 8 and the elastic member 12 shown in FIG. 5 are omitted for ease of understanding, and the elastic member 10 is shown as a leaf spring 10.

In image forming apparatuses such as the image forming apparatus 1 shown in FIG. 5 for example, transfer residual toner scraped off from the surface of the image carrier by the cleaning blade 7 may be collected (stored) in a toner sump (not shown), after which the waste toner in the toner sump is carried by a waste toner transport auger 15 in the waste toner transport unit and collected in a waste toner container (not shown). In examples described herein, the waste toner in the waste toner transport auger 15 is used as the waste toner supplied from the waste toner supply member to the coater roller 5.

FIG. 2 is a cross sectional view schematically showing the vicinity around the photosensitive body 2 of an example image forming apparatus, and the construction of the example image forming apparatus is similar to the construction of the image forming apparatus 1 shown in FIG. 5 and FIG. 6, with the exception that a rotary body 20 is provided as the waste toner supply member to the protective agent coater member (or protective agent coater) which may include the coater roller 5 and may further include the protective agent supply 6.

The rotary body 20 includes a shaft extending along the shaft 13 (e.g., in parallel with the shaft 13) of the coater roller 5 (see FIG. 6) and a cylinder-shaped part (cylindrical body) formed around the shaft, and the cylindrical body extends over the entire longitudinal length of the coater roller 5 along the shaft 13 of the coater roller 5. The cylindrical body may be a sponge roller formed of a urethane material and, in that case, the sponge roller is suitable as the rotary body 20 as it has a low hardness and is a foam body. However, as far as it can carry the toner, the member which may be used as the cylindrical body is not limited to a sponge roller. Further, the shaft may be columnar or cylindrical and may be formed of a resin (such as epoxy resin or phenol resin) and/or a metal (such as iron, aluminum or stainless).

The rotary body 20 is adapted to be rotationally driven by a driving means, which is not shown, at a predetermined speed of rotation around a rotational axis defined by its shaft to follow the rotation of the coater roller 5 in the direction of an arrow Re that is opposite in direction to the rotation direction Rd of the coater roller 5, such that it can perform in parallel both the drawing up of the waste toner from the waste toner transport unit and the supplying of the waste toner to the elastic body 14. One of the waste toner particles is indicated by the reference number 18.

The rotary body 20 is disposed in the vicinity of the surface of the elastic body 14 on the side opposing the elastic body 14, and is disposed in the vicinity of the waste toner transport unit on the side opposing the waste toner transport unit. For example, the rotary body 20 is in the vicinity of the waste toner transport unit such that an outer circumferential portion of the rotary body 20 can partly enter into the waste toner transport unit to acquire and carry the waste toner by contacting the waste toner in the waste toner transport auger 15 of the waste toner transport unit, and is disposed in the vicinity of the elastic body 14 such that the carried waste toner can be supplied to the surface of the elastic body 14 that comes in contact with the outer circumferential portion of the rotary body 20 as the rotary body 20 is rotated in the direction Re.

An operation of the rotary body 20 for supplying the waste toner to the surface of the elastic body 14 will be described. When the rotary body 20 is rotated by the driving means, which is not shown, in the direction of the arrow Re to follow the rotation of the coater roller 5 in the direction of the arrow Rd, part of the outer circumferential portion of the rotary body 20 enters into the waste toner transport unit to acquire (or receive) and carry the waste toner by contacting the waste toner in the waste toner transport auger 15. As the rotary body 20 continues to rotate in the direction of the arrow Re, the waste toner is supplied to the surface of the elastic body 14 that comes in contact with the outer circumferential portion of the rotary body 20 carrying the waste toner. While the rotary body 20 continues to rotate in the direction of the arrow Re, the coater roller 5 continues to rotate in the direction of the arrow Rd, which is opposite in direction, and the waste toner carried on the outer circumferential portion of the rotary body 20 is thereby supplied to and carried substantially by the entire surface of the elastic body 14. As the waste toner is abrasive in itself, upon making contact with the protective agent supply 6, the elastic body 14 carrying the waste toner can scrape off more of the protective agent from the protective agent supply 6, as compared with the case where the elastic body 14 does not carry the waste toner. The surface of the elastic body 14 thus carrying the waste toner scrapes off the protective agent from the protective agent supply 6 and applies the protective agent to the surface 2*b* of the photosensitive body 2 that comes in contact with the surface.

Accordingly, as the rotary body 20 can perform both the drawing up of the waste toner from the waste toner transport auger 15 in the waste toner transport unit and the supplying of the waste toner to the elastic body 14, the application of a suitable amount of protective agent substantially over the entire surface 2*b* of the photosensitive body 2 may be implemented more easily and at a lower cost.

FIG. 3 is a cross sectional view schematically showing the vicinity around the photosensitive body 2 of another example image forming apparatus, and the construction of the example image forming apparatus is similar to the construction of the image forming apparatus 1 shown in FIG. 5 and FIG. 6, with some exception. For example, in the example shown in FIG. 3, a first rotary body 30 and a second rotary body 32 are provided as the waste toner supply member to the protective agent coater member including the coater roller 5 and the protective agent supply 6. One of the waste toner particles is indicated by the reference number 18.

The second rotary body 32 includes a shaft (second rotary body shaft) extending along the shaft 13 (e.g., in parallel with the shaft 13) of the coater roller 5 (see FIG. 6) and a cylinder-shaped part (e.g. cylindrical body) formed around the second rotary body shaft, and the cylindrical body extends over the entire longitudinal length of the coater roller 5 along the shaft 13 of the coater roller. The first rotary body 30 includes a shaft (first rotary body shaft) extending along the second rotary body shaft (e.g., in parallel with the shaft) and a cylinder-shaped part (cylindrical body) formed around the first rotary body shaft, and the cylindrical body extends over the entire longitudinal length of the second rotary body 32 along the first rotary body shaft.

The first rotary body 30 may acquire (receive) and carry the waste toner from the waste toner transport auger 15. As an example, the first rotary body 30 may include a brush roller including a shaft and raised fibers protruding from the circumferential surface of the shaft. The fibers may include nylon, PET or rayon with a diameter of 3 to 6 d and may have a density of 25 to 100 kf. As an example, the second rotary body 32 may include a sponge roller.

The first rotary body 30 and the second rotary body 32 are rotationally driven in the directions of arrows Rf and Rg, which are opposite to each other, by respective driving motors (not shown) at respective predetermined speeds around rotational axes defined by respective shafts. The rotation direction Rg is opposite to the rotation direction Rd of the coater roller 5.

The first rotary body 30 is disposed in the vicinity of the second rotary body 32 on the side opposing the second rotary body 32, and is disposed in the vicinity of the waste toner transport unit on the side opposing the waste toner transport unit. The second rotary body 32 is disposed in the vicinity of the elastic body 14 on the side opposing the elastic body 14. More specifically, the first rotary body 30 is in the vicinity of (e.g. adjacent) the waste toner transport unit such that an outer circumferential portion of the first rotary body 30 can partly enter into the waste toner transport auger 15 in the waste toner transport unit to acquire and carry the waste toner by contacting the waste toner in the waste toner transport auger 15, and is disposed in the vicinity of the second rotary body 32 such that the carried waste toner can be supplied to an outer circumferential portion of the second rotary body 32 that comes in contact with the outer circumferential portion of the first rotary body 30 as the first rotary body 30 rotates in the direction Rf. Further, the second rotary body 32 rotates in the direction Rg when the first rotary body 30 rotates in the direction Rf, and is disposed in the vicinity of the elastic body 14 such that the waste toner supplied from the first rotary body 30 can be supplied to the surface of the elastic body 14 that comes in contact with the outer circumferential portion of the second rotary body 32 as it rotates.

The operations of the first rotary body 30 and the second rotary body 32 for supplying the waste toner to the surface of the elastic body 14 will be described. When the first rotary body 30 is rotated by the driving means, which is not shown, in the direction of the arrow Rf, part of the outer circumferential portion of the first rotary body 30 enters, as it rotates, into the waste toner transport unit to acquire and carry the waste toner by making contact with the waste toner in the waste toner transport unit. As the first rotary body 30 continues to rotate in the direction of the arrow Rf, the waste toner is supplied to the outer circumferential portion of the second rotary body 32 that is rotated together with the first rotary body 30 while contacting the outer circumferential portion of the first rotary body 30 carrying the waste toner. While the first rotary body 30 continues to rotate in the direction of the arrow Rf, the second rotary body 32 continues to rotate in the direction of the arrow Rg according to the rotational driving by the driving means, which is not shown, and as it rotates, the waste toner carried on the first rotary body 30 is supplied to the entire outer circumferential portion of the second rotary body 32. Then, as the second rotary body 32 continues to rotate in the direction of the arrow Rg, the elastic body 14 continues to rotate in the direction of the arrow Rd, which is opposite in direction and, as such, the waste toner carried on the outer circumferential portion of the second rotary body 32 is supplied to and carried by the entire surface substantially, of the elastic body 14. Thereafter, the elastic body 14 carrying the waste toner scrapes off the protective agent from the protective agent supply 6 and applies it to the surface 2*b* of the photosensitive body 2.

The waste toner supply member is adapted to include two separate rotary bodies, where the first rotary body 30 is arranged such that the waste toner can be drawn up from the waste toner transport unit and supplied to the second rotary body 32, and the second rotary body 32 is arranged such that the waste toner supplied from the first rotary body 30 is supplied to the elastic body 14 of the coater roller 5, and the respective rotary bodies may be adapted to implement the respective functions efficiently. Accordingly, the application of a suitable amount of protective agent substantially over the entire surface 2*b* of the photosensitive body 2 can be performed more efficiently.

FIG. 4 is a cross sectional view schematically showing the vicinity around the photosensitive body 2 of another example image forming apparatus, and the construction of the example image forming apparatus is similar to the construction of the image forming apparatus 1 shown in FIG. 5 and FIG. 6, with some exceptions. For example, the protective agent coater member which includes the coater roller 5 and the protective agent supply 6, is provided with a fixed body 40 as a transfer residual toner supply member. In FIG. 4, one of the waste toner particles is indicated by a reference number 42.

The fixed body 40 is disposed in the vicinity of (or adjacent) the surface of the elastic body 14 such that the surface of the elastic body 14 abuts against an upper surface of the fixed body 40 to form a nip on the side opposing the fixed body 40. Accordingly, as the elastic body 14 rotates, transfer residual toner acquired from the surface 2*b* of the photosensitive body 2 is routed through the surface of the elastic body 14 and stored on the fixed body 40. Accordingly, the transfer residual toner which would be lost after spilling off (or dropping off) the elastic body 14 in the absence of the fixed body 40 can be once again carried on the surface of the elastic body 14.

The fixed body 40 may be a fixed member which extends all or part of the longitudinal direction (vertical to the plane of paper in FIG. 4) of the coater roller 5 along the shaft 13 of the coater roller 5. The fixed body 40 may have a quadratic prism or cylindrical profile shape, but these shapes are not restrictive insofar as the fixed body 40 is of a shape that can store thereon the transfer residual toner routed through the surface of the elastic body 14. The fixed body 40 may be formed of a resin such as ABS or PP, or a metal such as aluminum or SUS.

An operation for supplying the waste toner on the fixed body 40 to the surface of the elastic body 14 will be described. As described above, the transfer residual toner is routed through the surface of the elastic body 14 and stored on the fixed body 40 and, when the coater roller 5 rotates in the direction of the arrow Rd in FIG. 4, part of the surface of the elastic body 14 abuts against the fixed body 40 to form a nip and makes pressure contact with the transfer residual toner stored on the fixed body 40 to acquire and carry the transfer residual toner. As the surface of the elastic body 14 rotates in the direction of the arrow Rd, the transfer residual toner acquired from the fixed body 40 is carried on the overall surface. As the transfer residual toner is abrasive in itself, the elastic body 14 can scrape off more of the protective agent from the protective agent supply 6, as compared with the case where the fixed body 40 is not provided. The elastic body 14 applies the protective agent scraped off from the protective agent supply 6 to the surface 2*b* of the photosensitive body 2 that comes in contact with the surface of the elastic body 14.

Accordingly, a more suitable amount of protective agent can be applied to the overall surface 2*b* of the photosensitive body 2.

With reference to FIG. 2, a protective agent coater member (or protective agent coater) of another example image forming apparatus will be described. In the example image forming apparatus of FIG. 2, the protective agent coater member may include a flicker 24.

The flicker 24 is disposed downstream of the rotary body 20 in the rotation direction of the coater roller 5 between the contact portion of the elastic body 14 (see FIG. 6) with the protective agent supply 6 (the protective agent thereof) and the rotary body 20, i.e., the waste toner supply member. The flicker 24 is also fixed to an inner wall of the housing of the image forming apparatus for making uniform contact with the elastic body 14 over the longitudinal direction (the direction vertical to the plane of paper in FIG. 2) of the elastic body 14 along the shaft 13 of the coater roller 5 (see FIG. 6), so as to regulate the waste toner on the surface of the elastic body 14 in such a manner that the waste toner supplied from the rotary body 20 is uniformly carried on the surface as the elastic body 14 rotates.

The flicker 24 may include an elongated plate whose longitudinal direction extends over the entire widthwise direction of the elastic body 14 along the shaft 13 of the coater roller 5, and is adapted such that a longitudinal edge of the plate makes contact with the surface of the elastic body 14. The flicker 24 may be made of, for example, SUS material (stainless steel).

As the flicker 24 enables the surface of the elastic body 14 to carry the waste toner uniformly, the elastic body 14 can scrape off from the protective agent supply 6 a suitable amount of protective agent uniformly. As a suitable amount of protective agent can thereby be uniformly applied to the surface 2*b* of the photosensitive body 2, abrasion of the photosensitive body 2 by the cleaning blade 7 can be better suppressed.

The flicker 24 may also be provided to the protective agent coater member in the examples shown in FIG. 3 and FIG. 4, to perform a similar function and achieve a similar effect as those of the flicker 24 in the example shown in FIG. 2, in order to better suppress abrasion of the photosensitive body 2 by the cleaning blade 7.

Example methods for operating the protective agent coater member (or protective agent coater) to apply the protective agent to the surface 2*b* of the photosensitive body 2 according to some of the above-described examples will be described. In some examples, the operation of components such as the elastic body 14 is performed under the control of a control unit, including a control element (such as a microprocessor), which is not shown, forming part of the image forming apparatus 1 shown in FIG. 5.

An example method of operating the protective agent coater member (or protective agent coater) of the example shown in FIG. 2 for applying the protective agent to the surface 2*b* of the photosensitive body 2 will be described. The elastic body 14 (see FIG. 6) of the coater roller 5 is rotated in the direction of the arrow Rd, to follow the rotation of the photosensitive body 2 which rotates in the direction of the arrow Ra. The rotation direction Rd of the elastic body 14 is opposite to the direction Ra of the photosensitive body 2. The rotary body 20 is rotated in the direction of the arrow Re, which is opposite in direction to the rotation direction Rd of the elastic body 14, so as to follow the rotation of the elastic body 14. The outer circumferential portion of the rotary body 20 rotated in the direction of the arrow Re acquires (receives) and carries waste toner by contacting the waste toner in the waste toner transport auger 15 in the waste toner transport unit. The surface of the elastic body 14 rotated in the direction of the arrow Rd acquires (receives) and carries the waste toner carried on the outer circumferential portion of the rotary body 20 by contacting the outer circumferential portion of the rotary body 20 rotated in the direction of the arrow Re. The elastic body 14 rotated in the direction Rd scrapes off the protective agent from the protective agent supply 6 that contacts the surface of the elastic body 14, and carries the protective agent on the surface of the elastic body 14. The surface 2*b* of the elastic body 14 the coater roller 5 rotated in the direction Rd contacts the surface 2*b* of the photosensitive body 2 rotated in the direction of the arrow Ra and applies the protective agent carried on the surface of the elastic body 14 to the surface of the photosensitive body 2.

Accordingly, the application of a suitable amount of protective agent substantially over the entire surface 2*b* of the photosensitive body 2 can be implemented more easily and at a lower cost.

An example method of operating the protective agent coater member (or protective agent coater) according to the example shown in FIG. 3 for applying the protective agent to the surface 2*b* of the photosensitive body 2 will be described. The elastic body 14 (see FIG. 6) of the coater roller 5 is rotated in the direction of the arrow Rd, to follow the rotation of the photosensitive body 2 in the direction of the arrow Ra. The rotation direction Rd of the elastic body 14 is opposite to the rotation direction Ra of the photosensitive body 2. The second rotary body 32 is rotated in the direction of the arrow Rg to follow the rotation of the elastic body 14, and the first rotary body 30 is rotated in the direction of the arrow Rf, which is opposite in direction to the rotation direction Rg of the second rotary body 32. The outer circumferential portion of the first rotary body 30 rotated in the direction of the arrow Rf acquires and carries waste toner by contacting the waste toner in the waste toner transport auger 15 of the waste toner transport unit. The outer circumferential portion of the second rotary body 32 rotated in the direction of the arrow Rg acquires (receives) and carries the waste toner carried on the outer circumferential portion of the first rotary body 30 by contacting the outer circumferential portion of the first rotary body 30 rotated in the direction of the arrow Rf. The surface of the elastic body 14 rotated in the direction of the arrow Rd acquires (receives) and carries the waste toner carried on the outer circumferential portion of the second rotary body 32 by contacting the outer circumferential portion of the second rotary body 32 rotated in the direction of the arrow Rg. The elastic body 14 the coater roller 5 rotated in the direction Rd scrapes off the protective agent from the protective agent supply 6 that contacts the surface of the elastic body 14, and carries the protective agent on the surface of the elastic body 14. The surface 2*b* of the elastic body 14 rotated in the direction Rd contacts the surface 2*b* of the photosensitive body 2 rotated in the direction of the arrow Ra and applies the protective agent carried on the surface of the elastic body 14 to the surface 2*b* of the photosensitive body 2.

Accordingly, the application of a suitable amount of protective agent substantially over the entire surface 2*b* of the photosensitive body 2 can be implemented more efficiently.

An example method of operating the protective agent coater member (or protective agent coater) according to the example shown in FIG. 4, for applying the protective agent to the surface 2*b* of the photosensitive body 2 will be described. The elastic body 14 (see FIG. 6) the coater roller 5 is rotated in the direction of the arrow Rd, to follow the rotation of the photosensitive body 2 which is in the direction of the arrow Ra. The rotation direction Rd of the elastic body 14 is opposite to the direction Ra of the photosensitive body 2. The surface of the elastic body 14 rotated in the direction of the arrow Rd acquires and carries transfer residual toner by making pressure contact with the transfer residual toner stored on the fixed body 40. The elastic body 14 of the coater roller 5 rotated in the direction Rd scrapes off the protective agent from the protective agent supply 6 that contacts the surface of the elastic body 14, and carries the protective agent on the surface of the elastic body 14. The surface of the elastic body 14 rotated in the direction Rd contacts the surface 2*b* of the photosensitive body 2 rotated in the direction of the arrow Ra and applies the protective agent carried on the surface of the elastic body 14 to the surface 2*b* of the photosensitive body 2.

Accordingly, a suitable amount of protective agent can be applied substantially over the entire surface 2*b* of the photosensitive body 2.

It is to be understood that not all aspects, advantages and features described herein may necessarily be achieved by, or included in, any one particular example. Indeed, having described and illustrated various examples herein, it should be apparent that other examples may be modified in arrangement and detail.

The invention claimed is:

1. An image forming apparatus comprising:

an image carrier to rotate in a rotation direction about a rotation axis;

a cleaning blade to contact a surface of the image carrier; and a protective agent coater having a rotatable shaft extending along the rotation axis of the image carrier, an elastic body formed around the rotatable shaft to transfer a protective agent from a protective agent supply to the image carrier, and a waste toner supply member to supply waste toner to the elastic body of the protective agent coater, wherein the protective agent coater is positioned upstream of the cleaning blade in the rotation direction of the image carrier.

2. The image forming apparatus of claim 1, wherein the waste toner supply member comprises a rotary body located adjacent to a waste toner transport unit to receive the waste toner from the waste toner transport unit, and adjacent to the elastic body of the protective agent coater to supply the waste toner to a surface of the elastic body.

3. The image forming apparatus of claim 2, wherein the rotary body of the waste toner supply member comprises a shaft portion extending along the rotatable shaft of the protective agent coater and a cylindrical body located around the shaft portion and along the shaft portion.

4. The image forming apparatus of claim 2, wherein the rotary body includes a sponge roller.

5. The image forming apparatus of claim 1, wherein the waste toner supply member comprises a first rotary body to receive the waste toner on an outer circumferential portion thereof from a waste toner transport unit, and a second rotary body to receive on an outer circumferential portion thereof the waste toner received by the first rotary body and to supply the waste toner to the elastic body.

6. The image forming apparatus of claim 5, wherein:

the first rotary body is located adjacent to the waste toner transport unit to contact the waste toner in the waste toner transport unit and receive the waste toner on the outer circumferential portion of the first rotary body, the first rotary body is located adjacent to the second rotary body to supply the waste toner to the outer circumferential portion of the second rotary body, and the second rotary body is located adjacent to the elastic body of the protective agent coater, to supply the waste toner supplied from the first rotary body to a surface of the elastic body.

7. The image forming apparatus of claim 6, wherein the second rotary body includes a rotary body shaft extending along the rotatable shaft of the protective agent coater and a cylindrical body formed in a cylinder shape around the rotary body shaft and along the rotary body shaft.

8. The image forming apparatus of claim 7, wherein the first rotary body includes a first rotary body shaft and a cylindrical body formed in a cylinder shape around the first rotary body shaft and along the first rotary body shaft, wherein the rotary body shaft of the second rotary body is a second rotary body shaft, and wherein the first rotary body shaft extends along the second rotary body shaft.

9. The image forming apparatus of claim 5, wherein the first rotary body includes a brush roller, and the second rotary body includes a sponge roller.

10. The image forming apparatus of claim 1, wherein the protective agent coater includes a flicker, the flicker is located downstream of the waste toner supply member in a rotation direction of the elastic body, between the waste toner supply member and a contact portion of the elastic body with the protective agent supply, and the flicker to uniformly contact the elastic body in a longitudinal direction of the elastic body along the rotatable shaft to uniformly carry the waste toner on a surface of the elastic body.

11. An image forming apparatus comprising:

an image carrier to rotate in a rotation direction about a rotation axis;

a cleaning blade to clean a surface of the image carrier by contacting a surface of the image carrier; and a protective agent coater having a rotatable shaft extending parallel to the rotation axis of the image carrier, an elastic body formed around the rotatable shaft to receive a protective agent from a protective agent supply, and a fixed body to supply the elastic body with transfer residual toner, wherein the protective agent coater is positioned upstream of the cleaning blade in the rotation direction of the image carrier, and wherein the fixed body is located adjacent the elastic body to direct the transfer residual toner on the image carrier via a surface of the elastic body of the protective agent coater and to store the transfer residual toner on the fixed body.

12. The image forming apparatus of claim 11, wherein the fixed body comprises resin or metal.

13. The image forming apparatus of claim 11, wherein the protective agent coater includes a flicker, and wherein the flicker is located downstream of the fixed body in a rotation direction of the elastic body between the fixed body and a contact portion of the elastic body with the protective agent supply, the flicker to uniformly contact the elastic body in a longitudinal direction of the elastic body along the shaft in order to uniformly carry the transfer residual toner supplied to the elastic body on the surface of the elastic body.

14. The image forming apparatus of claim 13, wherein the flicker includes an elongated plate extending in a longitudinal direction along a longitudinal direction of the elastic body.

15. A method of applying a protective agent on an image carrier in an image forming apparatus, comprising:

rotating a rotary body of a waste toner supply member in a protective agent coater, to receive waste toner from a waste toner transport unit; and rotating an elastic body of the protective agent coater, wherein the elastic body is in contact with the rotary body to receive the waste toner, wherein the elastic body rotates in contact with a protective agent supply to receive the protective agent, and wherein the elastic body rotates in contact with the image carrier to transfer the protective agent to a surface of the image carrier.

* * * * *